US007165905B1

(12) United States Patent
Kuo

(10) Patent No.: US 7,165,905 B1
(45) Date of Patent: Jan. 23, 2007

(54) AUTO-CONTROL PENCIL SUITABLE FOR PEN LEADS OF DIFFERENT SIZES

(75) Inventor: Ming-Mei Kuo, Taipei Hsien (TW)

(73) Assignee: Poleen Corporation, Yonghe (TW)

( * ) Notice: Subject to any disclaimer, the term of this patent is extended or adjusted under 35 U.S.C. 154(b) by 0 days.

(21) Appl. No.: 11/323,699

(22) Filed: Jan. 3, 2006

(51) Int. Cl.
*B43K 21/22* (2006.01)
*B43K 21/08* (2006.01)

(52) U.S. Cl. ..... 401/92; 401/75

(58) Field of Classification Search ..... 401/92, 401/93, 68, 75, 94, 116
See application file for complete search history.

(56) References Cited

U.S. PATENT DOCUMENTS 2,460,345 A * 2/1949 Gruber ..... 401/116
3,056,996 A * 10/1962 Aversa ..... 401/116
4,610,557 A * 9/1986 Malm ..... 401/75

* cited by examiner

*Primary Examiner*—David J. Walczak

(57) ABSTRACT

An auto-control pencil suitable for pen leads of different sizes comprises a pen tube; a guide tube; a push rod; a spring; a rotary head; an inner head; and an outer head. When an inner head is pressed downwards along the outer head, the presses at the front end of the inner head will reduce inwards so that one end of the pen lead resists against the opening at the front end of a push rod and moreover another end thereof is clamped by the presses so that the two ends of the pen leads are fixed. Pen leads of different sizes can be used. Thus one pen is sufficient.

4 Claims, 10 Drawing Sheets

AUTO-CONTROL PENCIL SUITABLE FOR PEN LEADS OF DIFFERENT SIZES

FIELD OF THE INVENTION

The present invention relates to pencils, and in particular to an auto-control pencil suitable for pen leads of different sizes, wherein the auto-control pencil is suitable for pen leads of different sizes so that users need not prepare many pencils for use. Thus one pen is sufficient. Thereby the installation of the pen lead of the present invention is easy. Furthermore, structure and components of the present invention are easy so as to save cost.

BACKGROUND OF THE INVENTION

The prior art auto-control pencils are designed to have different specifications and sizes for the different uses of the pencils. The user selects a desired one according to the usages. Thus, it is often that the users must prepare various pencils for uses. However this prior art way has the following disadvantages. The cost is high for preparing various pencils. Moreover the users must carry multiple pencils for use. It is inconvenient.

Furthermore, the prior art auto-control pencils have complicated structures. Thereby some problems are induced. The first one is that the prior art auto-control pencils are only suitable for one size of pen lead. Further it is installed to repair the pencils. Moreover some parts must be detached for installing the pen lead. The cost for the prior art auto-control pencil is high and the lifetime is short.

Thereby the prior art auto-control pencils are not practical and cost-effective and are necessary to be improved.

SUMMARY OF THE INVENTION

Accordingly, the primary object of the present invention is to provide an auto-control pencil suitable for pen leads of different sizes so that users need not prepare many pencils for use. Thus one pen is sufficient. Thereby, the installation of the pen lead of the present invention is easy. Furthermore, the structure and components of the present invention are easy so as to save cost.

To achieve above objects, the present invention provides an auto-control pencil suitable for pen leads of different sizes. The pencil comprises a pen tube; a guide tube; a push rod; a spring; a rotary head; an inner head; and an outer head. When an inner head is pressed downwards along the outer head, the presses at the front end of the inner head will reduce inwards so that one end of the pen lead resists against the opening at the front end of a push rod and moreover another end thereof is clamped by the presses so that the two ends of the pen leads are fixed. Pen leads of different sizes can be used. Thus one pen is sufficient. Thereby the installation of the pen lead or the present invention is easy. Furthermore, the structure and components of the present invention are easy so as to save cost.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
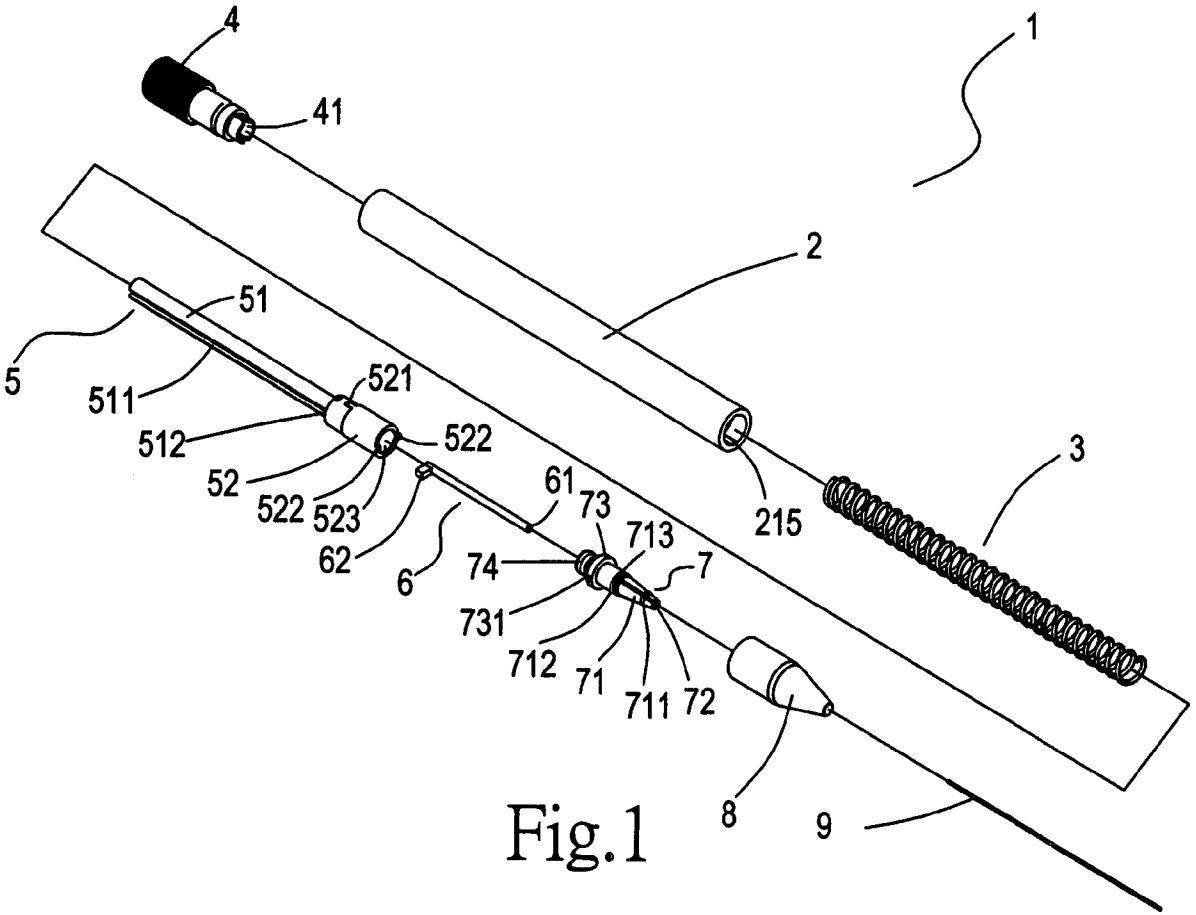
FIG. 1 is an exploded schematic view of the auto-control pencil suitable for pen leads of different sizes of the present invention.
Figure 2:
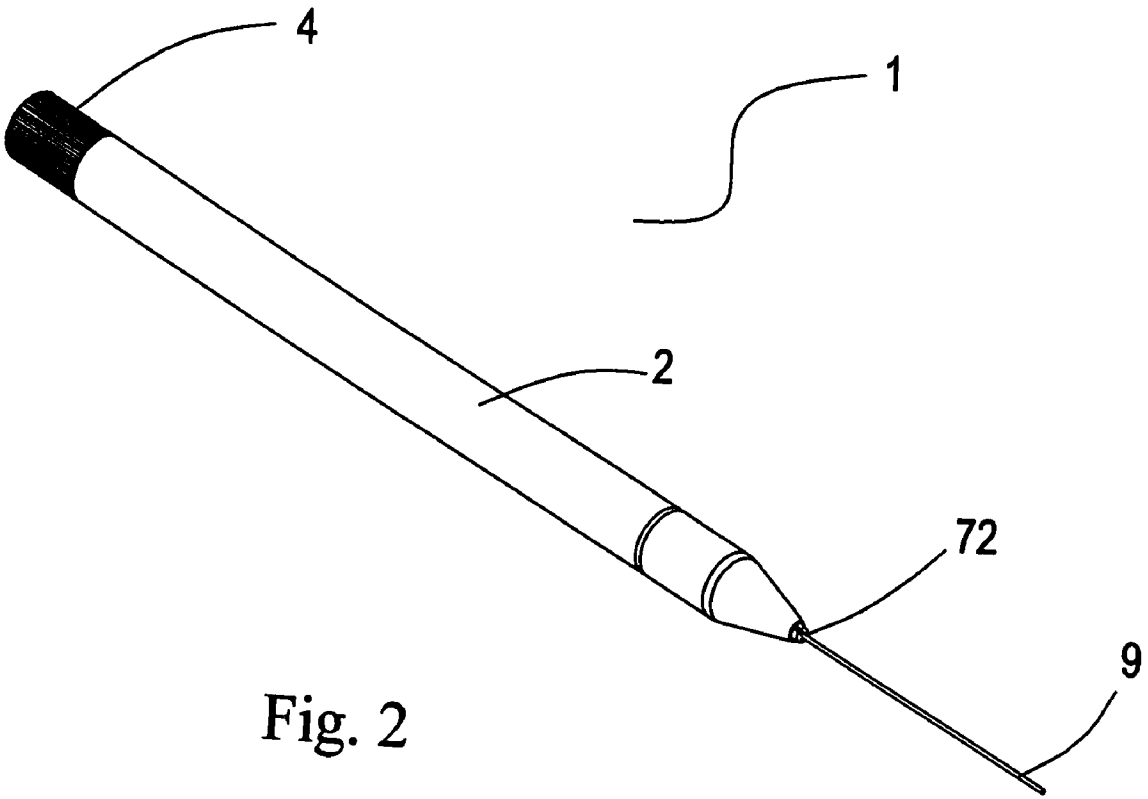
FIG. 2 is a perspective view about the auto-control pencil suitable for pen leads of different sizes of the present invention.
Figure 3:
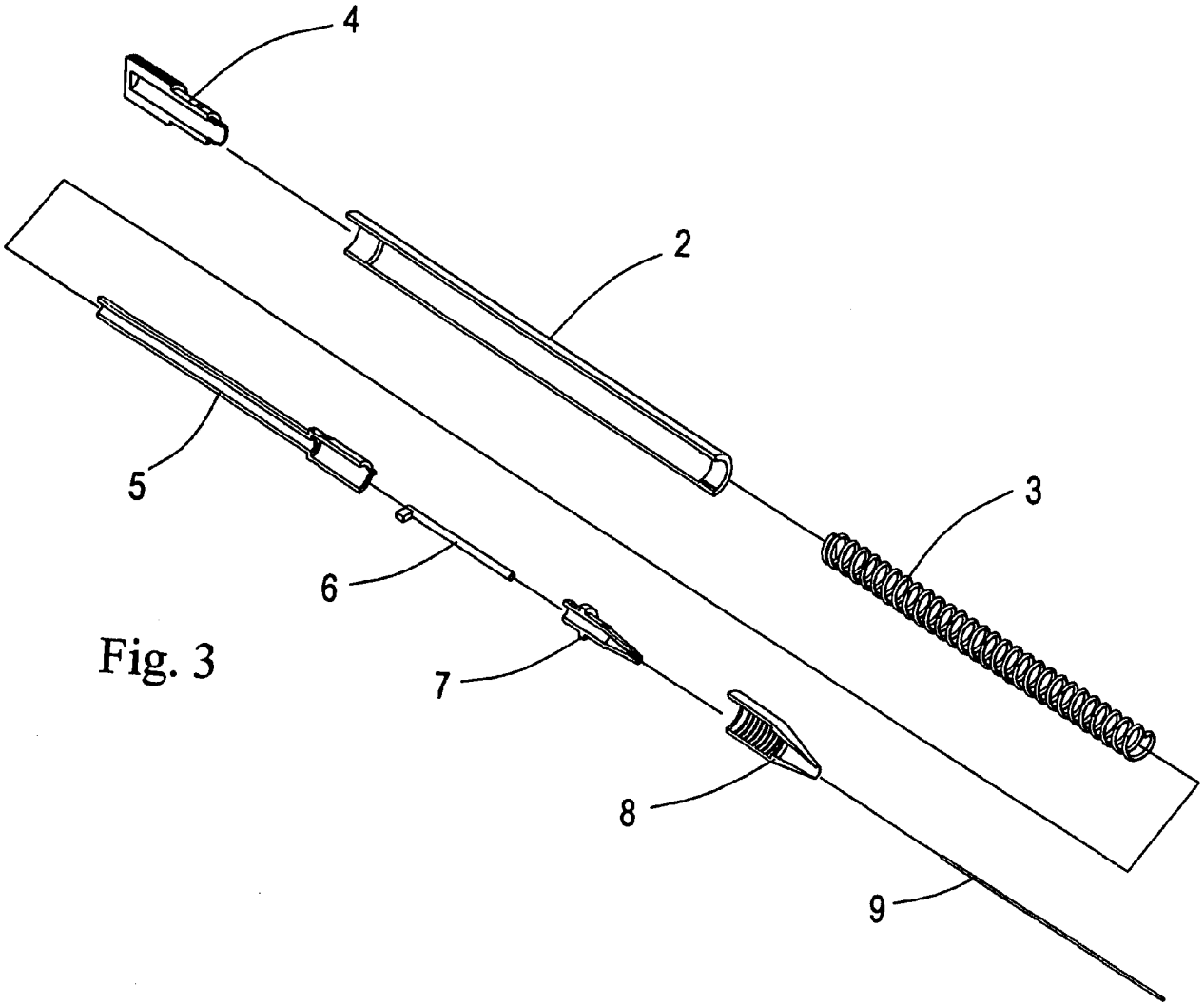
FIG. 3 is a cross sectional view about the auto-control pencil suitable for pen leads of different sizes of the present invention.

Referring to FIGS. 1, 2 and 3, the structure of the present invention is illustrated. The present invention has the following elements.

A pen tube 2 has an inner recess 215 at a front inner side thereof.

A guide tube 5 has a trench 511 at a lateral side thereof. The guide tube 5 is formed of an extension bar 511 and a connecting unit 52. Two buckles 521 are installed between the connection of the extension bar 51 and the connecting unit 52. The buckles 521 can be buckled to the recess 215 of the pen tube 2. A side of the connecting unit 52 near the extension bar 51 is an enlarged portion 512. The connecting unit 52 has a fixing hole 523.

A push rod 6 has an opening 61 at a front end thereof for receiving pencil lead 9 of different sizes. A rear end of the push rod 6 has a block 62. When the push rod 6 is placed within the guide tube 5, the block 62 protrudes out of the trench 511 of the guide tube 5. A front end of the connecting unit 52 has two confining projections 522 which is embedded into the notches 731 of the inner head 7.

A spring 3 is installed to the extension bar 51 of the guide tube 5. One end or the spring 3 resists against the enlarged portion 512 of the guide tube 5. The pen tube 2 is installed at an outer side of the spring 3. The inner recess 215 of the pen tube 2 is engaged to the buckles 521 of the guide tube 5.

A rotary head 4 is installed at a rear end of the pen tube 2. A front end of the rotary head 4 has a sheet 41 for fixing one end of the spring 3.

An inner head 7 has two notches 731. The inner head 7 has three presses 71 at a front end thereof, as shown in FIG.

Figure 4:
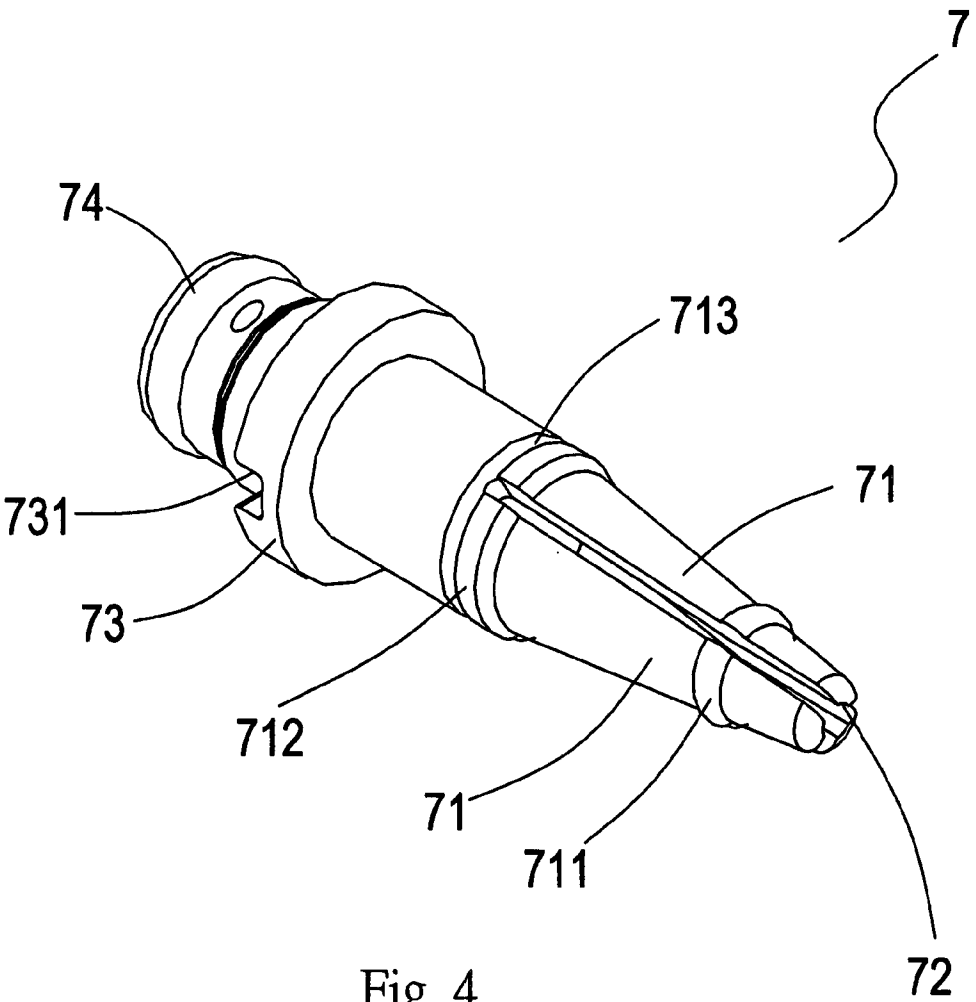
FIG. 4 is a schematic view about the inner head of the auto-control pencil suitable for pen leads of different sizes of the present invention.

4. A front ring 711 is installed at a front end of the presses 71 and a rear ring 712 is installed at a rear end of the presses 71. One side of the rear ring 712 is formed with a concave portion 713 for increasing the elasticity of the presses 71. A tip recess 72 is formed at the front ends of the presses 71. The number of the presses is not confined by three, other number is permissible, as shown in FIG. 4. A middle section of a stop ring 73 has the two notches 731. A rear end of the inner head 7 is extended with a buckling ring 74. When the inner head 7 is combined to the guide tube 5, the buckling ring 74 will be placed into the fixing hole 523 of the connecting unit 52. The two notches 731 serve for receiving the two confining projections 522 of the connecting unit 52. However, the number of the presses 71 is not confined by three, and it is only necessary that the number of the presses 71 is greater than one. That is at least two presses being formed at the inner head 7. Each press 71 may have a cambered shape.

Figure 5:
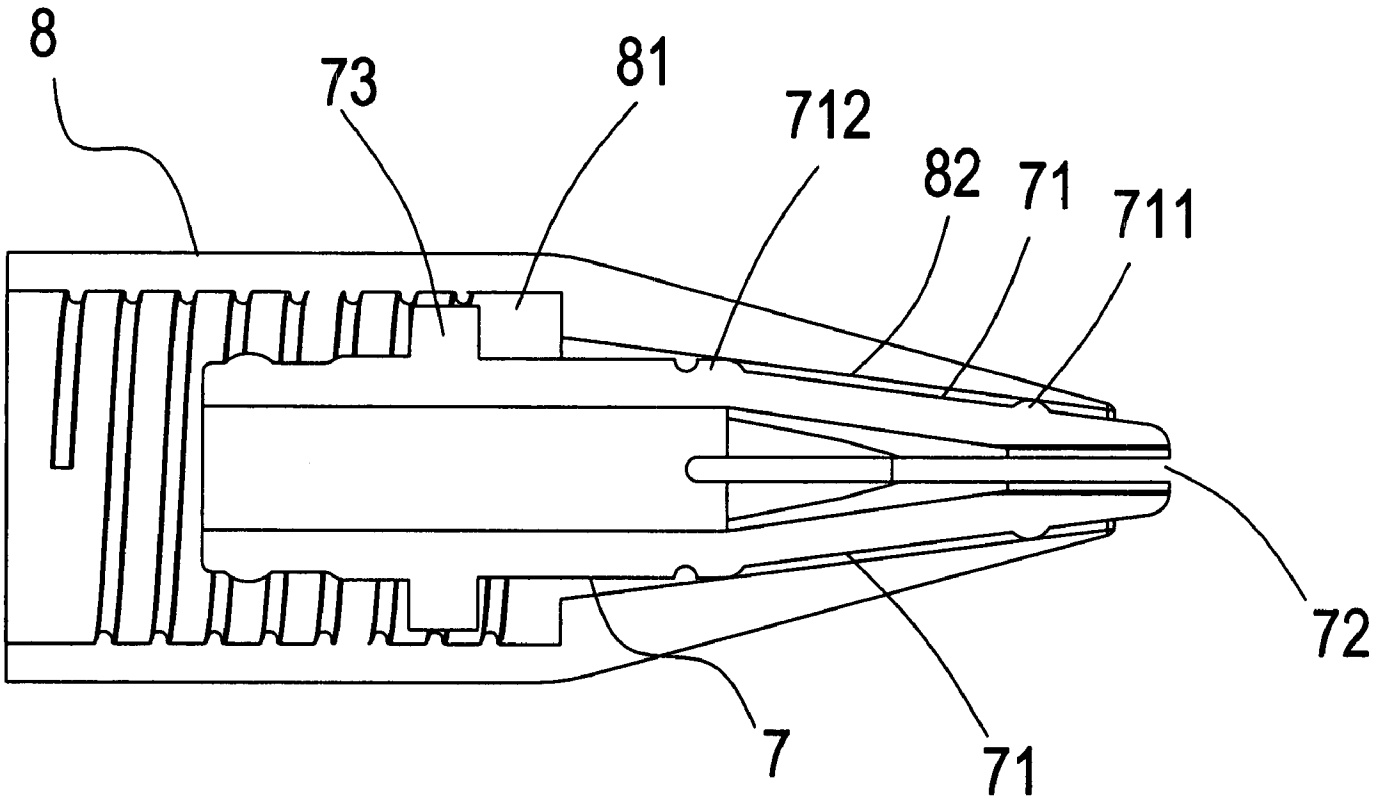
FIG. 5 is a cross sectional view about the inner head of the auto-control pencil suitable for pen leads of different sizes of the present invention.
Figure 6:
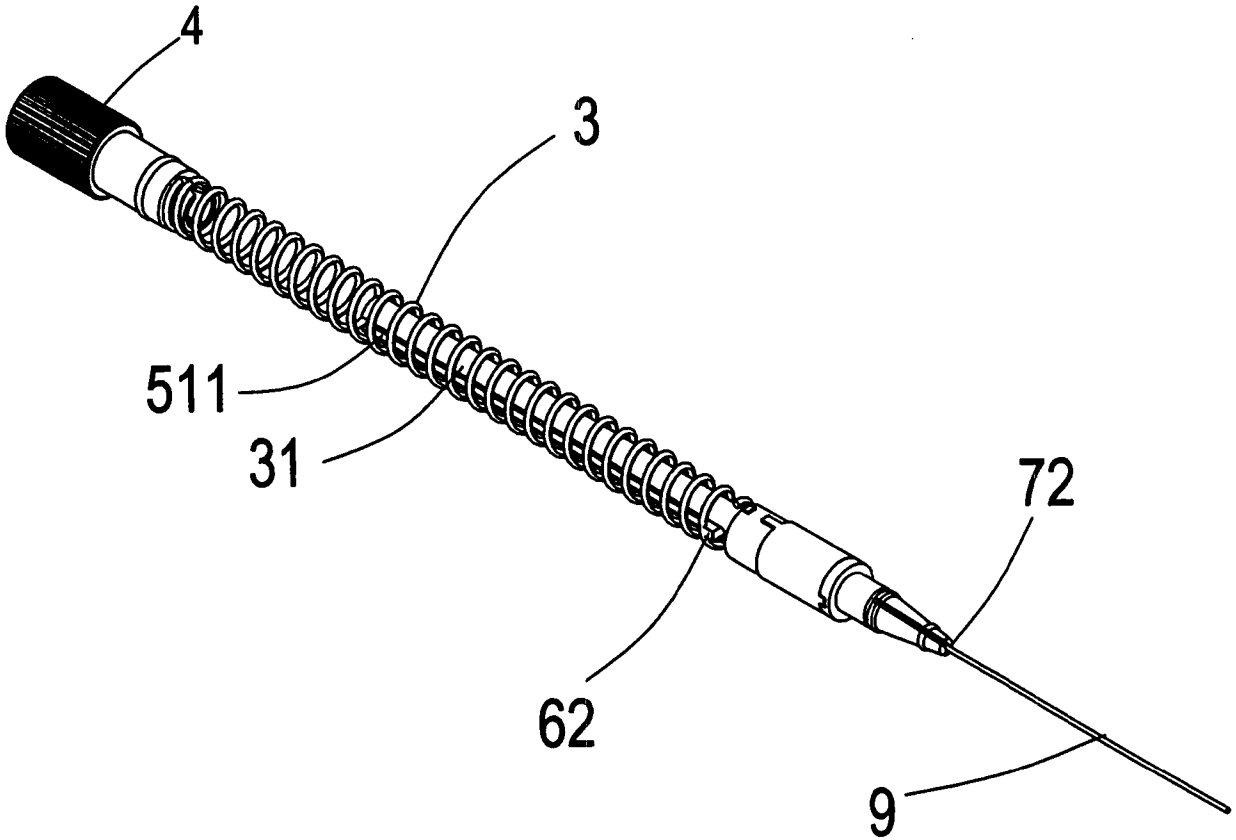
FIG. 6 is a schematic view showing the combination of the inner head of the present invention.

An outer head 8 is installed at an outer side of the inner head 7, as shown in FIG. 5. An inner side of the outer head 8 is annularly formed with an annular ring 81 for resisting against the stop ring 73 of the inner head 71. The front ring 711 and rear ring 712 are in contact to the inclined surface 82 of the outer head 8 for reducing friction force. When the inner head 7 is pressed downwards along the outer head 8, the presses 71 at the front end of the inner head 7 will reduce inwards so that one end of the pen lead 9 resists against the opening 61 at the front end of the push rod 6 and moreover another end thereof is clamped by the presses 71 so that the two ends of the pen leads 9 are fixed.

Figure 7:
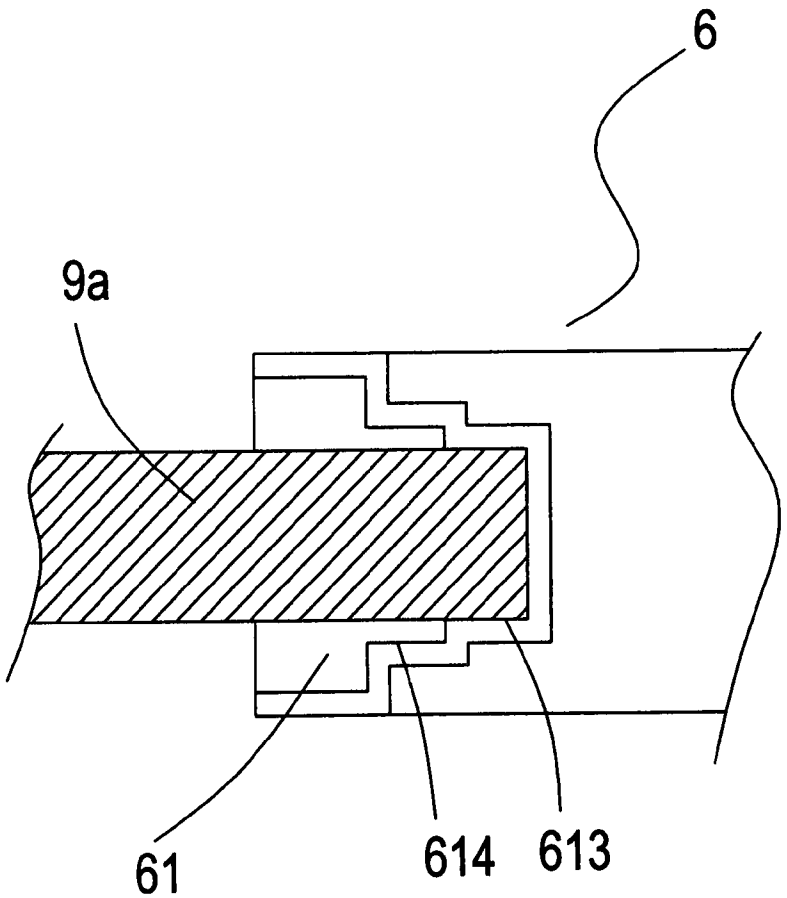
FIG. 7 is a schematic view about the operation of placing a slender pen lead into a stepped shape recess according to the present invention.

Referring to FIG. 7, the operation of the present invention is illustrated, where the opening 61 has a stepped shape with two sections 613, 614 so as to fit slender or greater pen lead 9*a*.

Figure 8:
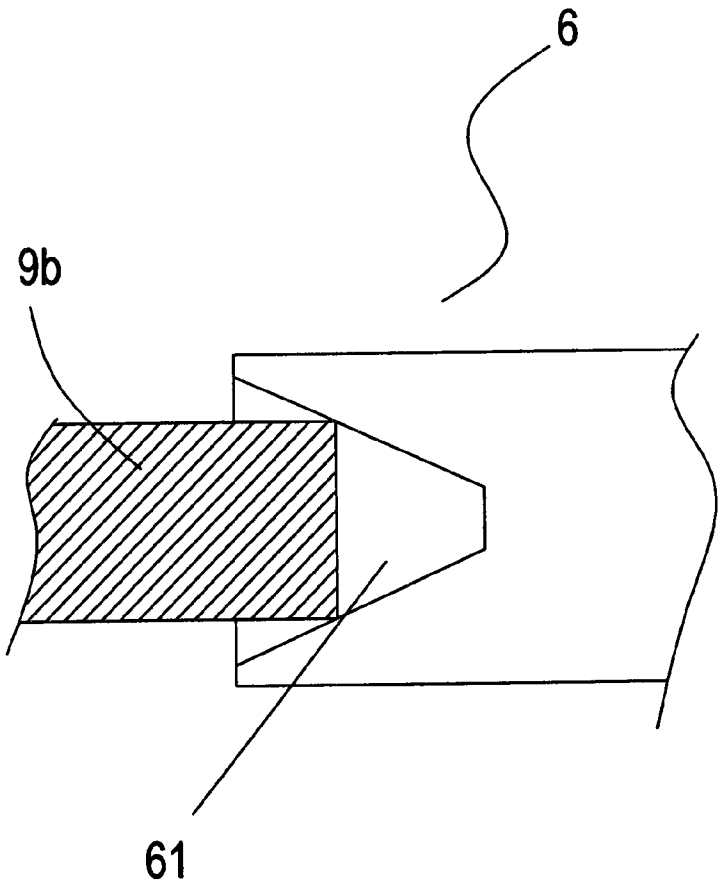
FIG. 8 is a schematic view about the operation of placing a greater pen lead into a stepped shape recess according to the present invention.

Referring to FIG. 8, the opening 61 has an inclined shape so as to have different effect.

The use of the present invention is illustrated in FIG. 1. When the user rotates the rotary head 4, the spring 3 will rotate so that the block 62 will move in the trench 511 of the guide tube 5 to drive the pen lead 9 to move. When the user desires to place the pen lead 9 into the pen 1, it is only necessary to rotate to the rotary head 4 to one side so that the pen lead 9 protrudes out of the tip recess 72 for writing.

Figure 9:
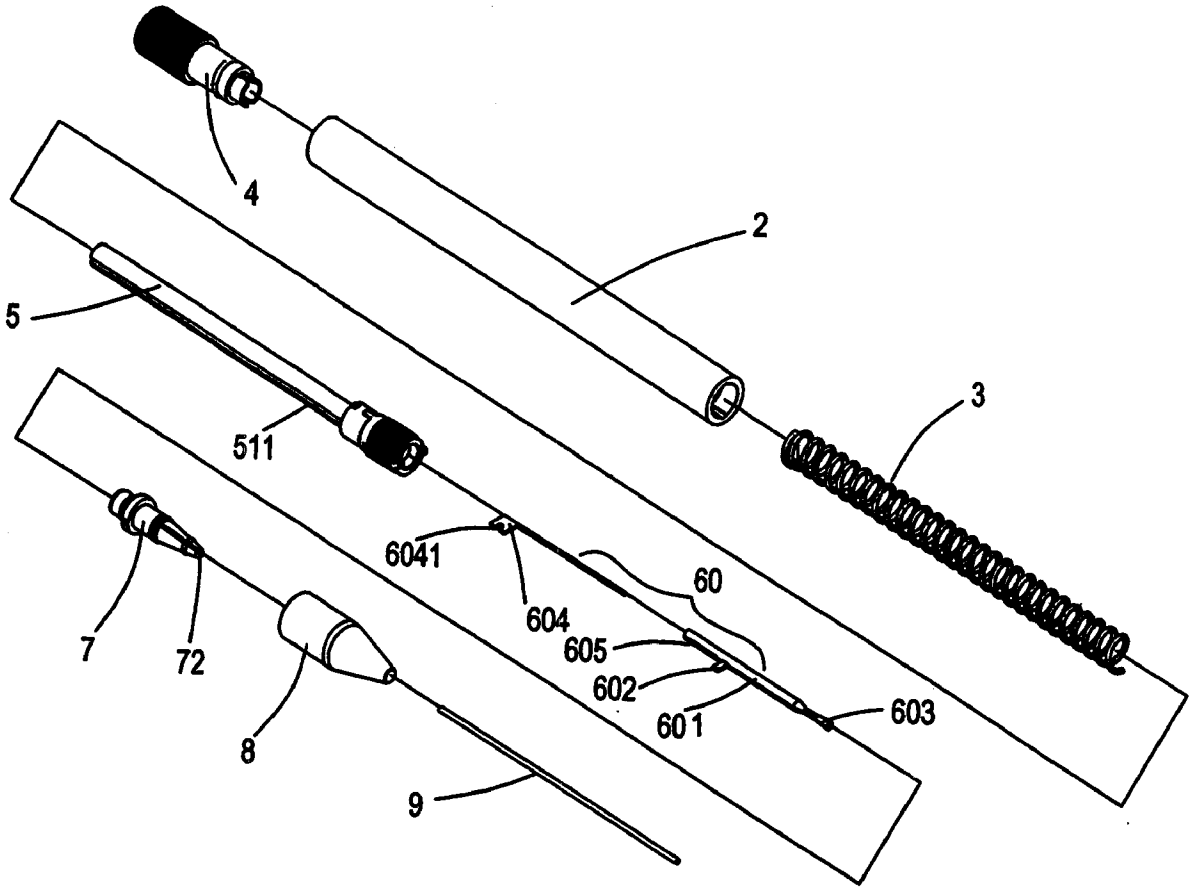
FIG. 9 is an exploded view showing that the present invention is suitable for various sizes of the pen leads.

Referring to FIG. 9, a trumpet sleeve 603 is installed at a front end of the push rod 6. The sleeve 603 is made of elastic material. The push rod 6 has a body 601 which is a hollow rod. A fixing block 602 is installed one the body 601. A rear end of the body 601 has a slot 605. A guide rod 604 is placed within the slot 605. The guide rod 604 has a buckling sheet 6041 which is protruded out from the guide rod 604. A length of the slot 605 is greater than that of the buckling sheet 6041.

Figure 10:
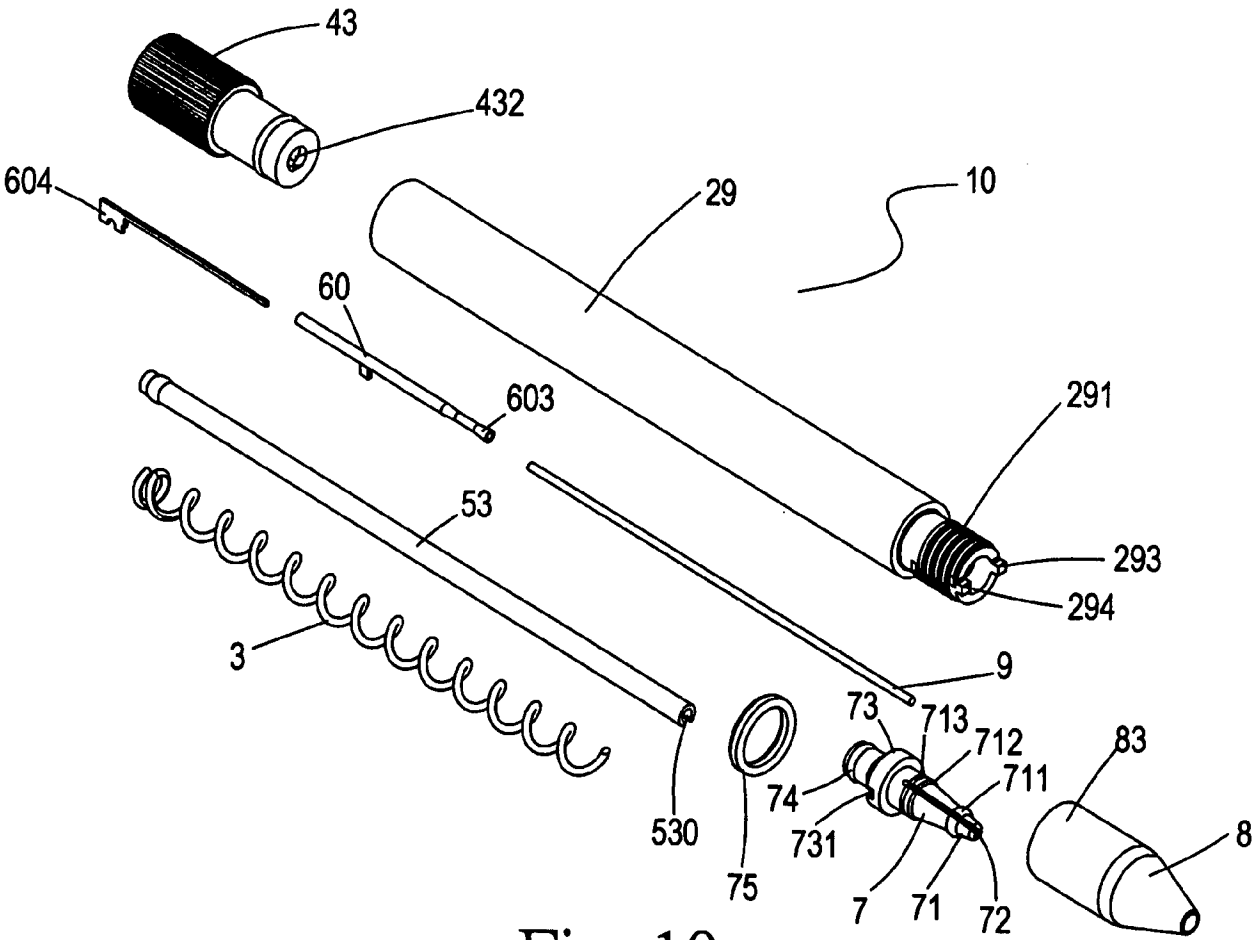
FIG. 10 is an exploded schematic view showing another embodiment of the present invention.

Referring to FIG. 10, the second embodiment of the present invention is illustrated.

A pen tube 29 has a thread portion 291 at a front end thereof and an end opening of the pen tube 29 has two nose portions 293, 294.

A guide tube 53 has a trench 530 at a lateral side thereof.

A push rod 60 has an opening 61 at a front end thereof for receiving pencil lead 9 of different sizes. A guide rod 604 has a buckling sheet which is protruded out from the guide rod.

A spring 3 is installed to the guide tube 53. The pen tube 2 is installed at an outer side of the spring 3.

A rotary head 41 is installed at a rear end of the pen tube 2. A front end of the rotary head 43 has an engaging ring 432 for fixing one end of the spring 3.

An inner head 7 has two notches 731. The inner head 7 has three presses 71 at a front end thereof, as shown in FIG. 4. A front ring 711 is installed at a front end of the presses 71 and a rear ring 712 is installed at a rear end of the presses 71. One side of the rear ring 712 is installed with a concave portion 713 for increasing the elasticity of the presses 71. A tip recess 72 is formed at the front ends of the presses 71. The number of the presses is not confined by three, other number is permissible. A middle section of a stop ring 73 has the two notches 731. A rear end of the inner head 7 is extended with a buckling ring 74. However, the number of the presses 71 is not confined by three, and it is only necessary that the number of the presses 71 is greater than one. That is at least one presses being formed at the inner head 7.

An outer head 8 is installed at an outer side of the inner head 7, as shown in FIG. 5. An inner side of the outer head 8 is annularly formed with an annular ring 81 for resisting against the stop ring 73 of the inner head 7. The front ring 711 and rear ring 712 are in contact to the inclined surface 82 of the outer head 8 for reducing friction force. When the inner head 7 is pressed downwards along the outer head 8, the presses 71 at the front end of the inner head 7 will reduce inwards so that one end of the pen lead 9 resists against the opening 61 at the front end of the push rod 6 and moreover another end thereof is clamped by the presses 71 so that the two ends of the pen leads 9 are fixed.

Advantages of the present invention will be described herein. In the present invention, pen leads of different sizes can be used. Thus one pen is sufficient. Thereby the installation of the pen lead of the present invention is easy. Furthermore, the structure and components of the present invention are easy so as to save cost.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An auto-control pencil suitable for pen leads of different sizes comprising:

a pen tube having an inner recess at a front inner side thereof;

a guide tube having a trench at a lateral side thereof; the guide tube being formed of an extension bar and a connecting unit; two buckles being installed between the connection of the extension bars and the connecting unit; the buckles can be buckled to the recess of the pen tube; a side of the connecting unit near the extension bar being an enlarged portion; the connecting unit having a fixing hole;

a push rod having an opening at a front end thereof for receiving pencil lead of different sizes; a rear end of the push rod having a block; when the push rod is placed within the guide tube, the block protruding out of the trench of the guide tube; a front end of the connecting unit having two confining projections which is embedded into two notches of the inner head;

a spring being installed to the extension bar of the guide tube; one end of the spring resisting against the enlarged portion of the guide tube; the pen tube being installed at an outer side of the spring; the inner recess of the pen tube being engaged to the buckles of the guide tube;

a rotary head installed at a rear end of the pen tube; a front end of the rotary head having a sheet for fixing one end of the spring; and an inner head having the two notches; the inner head having at least two presses at a front end thereof; a front ring being installed at a front end of the presses and a rear ring being installed at a rear end of the presses; a tip recess being formed at the front ends of the presses; a middle section of a stop ring having the two notches; a rear end of the inner head being extended with a buckling ring; when the inner head being combined to the guide tube, the buckling ring will be placed into the fixing hole of the connecting unit; the two notches serving for receiving the two confining projections of the connecting unit; and an outer head installed at an outer side of the inner head, an inner side of the outer head being annularly formed with an annular ring for resisting against the stop ring of the inner head; the front ring and rear ring being in contact to the inclined surface of the outer head for reducing friction force;

wherein when the inner head is pressed downwards along the outer head, the presses at the front end of the inner head will reduce inwards so that one end of the pen lead resists against the opening at the front end of the push rod and moreover another end thereof is clamped by the presses so that the two ends of the pen leads are fixed.

2. The auto-control pencil suitable for pen leads of different sizes as claimed in claim 1, wherein the opening has a stepped shape with two sections so as to fit slender or greater pen lead.

3. The auto-control pencil suitable for pen leads of different sizes as claimed in claim 1, wherein one side of the rear ring is formed with a concave portion for increasing the elasticity of the presses.

4. The auto-control pencil suitable for pen leads of different sizes as claimed in claim 1, wherein each press has cambered shape.

* * * * *